United States Patent [19]

Kamp

[11] Patent Number: 4,921,181

[45] Date of Patent: May 1, 1990

[54] YARN TRAVERSE WINDING APPARATUS

[75] Inventor: Heinz Kamp, Wegberg, Fed. Rep. of Germany

[73] Assignee: W. Schlafhorst & Co., Mönchen-Gladbach, Fed. Rep. of Germany

[21] Appl. No.: 276,057

[22] Filed: Nov. 25, 1988

[30] Foreign Application Priority Data

Nov. 25, 1987 [DE] Fed. Rep. of Germany ..... 3739850

[51] Int. Cl.[5] ..... B65H 54/30

[52] U.S. Cl. ..... 242/43 A; 242/158 B

[58] Field of Search ..... 242/43 A, 43 R, 43.1, 242/158 B

[56] References Cited

U.S. PATENT DOCUMENTS 3,333,782 8/1967 Beckwith, Jr. ..... 242/43 A

FOREIGN PATENT DOCUMENTS 972440 1/1951 France .

444732 2/1968 Switzerland .

*Primary Examiner*—Stanley N. Gilreath

*Attorney, Agent, or Firm*—Herbert L. Lerner; Laurence A. Greenberg

[57] ABSTRACT

A yarn traverse winding apparatus for a textile machine producing cross-wound bobbins includes a yarn traversing zone having reversing points. A traction mechanism transmission has an endless traction mechanism being diverted outside the traversing zone by guide rollers between a first belt run movable in a given traversing direction and a second belt run movable parallel to the first belt run in an opposite traversing direction. The belt runs have inner surfaces facing toward each other and outer surfaces facing away from each other while in the traversing zone. Yarn are drivers mutually spaced apart along the traction mechanism and a yarn guide element transfers yarn at the reversing points from a yarn driver on one of the belt runs to a yarn driver on the other of the belt runs. The guide rollers include two first inner guide rollers each guiding and contacting the outer surface of a respective belt run and two mutually spaced apart second outer guide rollers each returning and contacting the inner surface of a respective belt run before the belt runs reach the first guide rollers. The traction mechanism is moveable between the second guide rollers in the vicinity of the first guide rollers.

5 Claims, 2 Drawing Sheets

YARN TRAVERSE WINDING APPARATUS

Figures 1, 2:
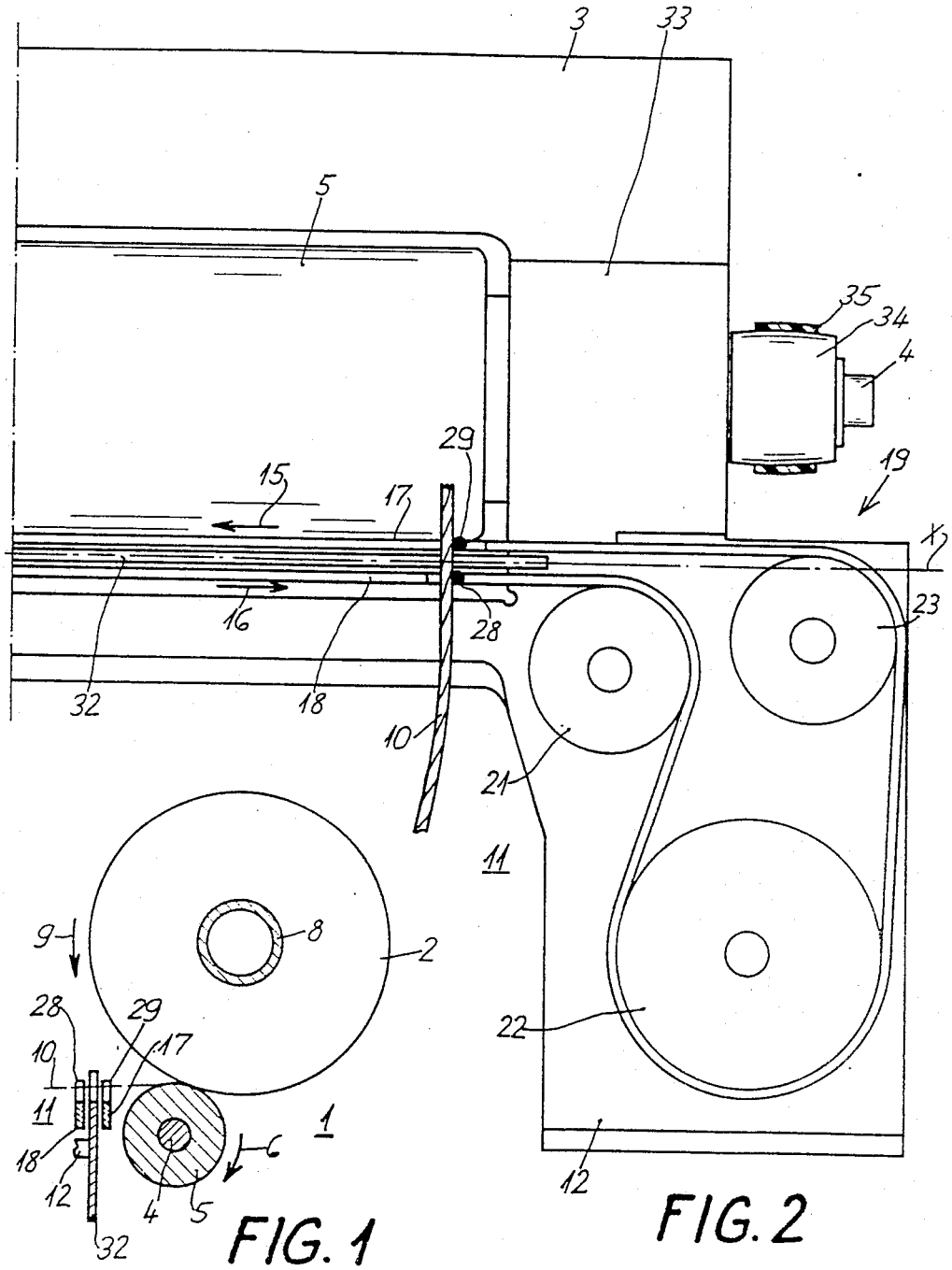

The invention relates to a yarn traverse winding apparatus for a textile machine that produces cross-wound bobbins or cheeses, including a traction mechanism transmission having an endless traction mechanism which forms a first belt run movable in a traversing direction and a second belt run movable parallel to the first in the opposite traversing direction, yarn drivers are mutually spaced apart along the traction mechanism, the yarn is given up from a yarn driver of one belt run to a yarn driver of the other belt run at reversing points of the traversing motion, with the aid of a yard guide element, and the traction mechanism is diverted from one belt run to the other outside the traversing zone by means of guide rollers.

A textile machine that produces cheeses or cross-wound bobbins, such as an automatic bobbin winder, as a rule has a plurality of individual winding stations or winding devices. These winding stations or devices are usually arranged in a row. Since the traction mechanism belt run of the yarn traverse winding apparatus must be diverted outside the traversing zone and requires space for this purpose, the width of the yarn traverse winding apparatus determines the spacing intervals of the various bobbin winding stations and thus the length of the entire textile machine.

It is accordingly an object of the invention to provide a yarn traverse winding apparatus, which overcomes the hereinafore-mentioned disadvantages of the heretofore-known devices of this general type and which furnishes preconditions for minimizing spacing and thereby reducing the cost and engineering expense of the textile machine.

With the foregoing and other objects in view there is provided, in accordance with the invention, a yarn traverse winding apparatus for a textile machine producing cross-wound bobbins, comprising a yarn traversing zone having reversing points, guide rollers, a traction mechanism transmission having an endless traction mechanism being diverted outside the traversing zone by the guide rollers between a first belt run movable in a given traversing direction and a second belt run movable parallel to the first belt run in an opposite traversing direction, the belt runs having inner surfaces facing toward each other and outer surfaces facing away from each other while in the traversing zone, yarn drivers mutually spaced apart along the traction mechanism, a yarn guide element transferring yarn at the reversing points from a yarn driver on one of the belt runs to a yarn driver on the other of the belt runs, the guide rollers including two first inner guide rollers each guiding and contacting the outer surface of a respective belt run and two second outer guide rollers spaced apart from the first guide rollers and each returning and contacting the inner surface of a respective belt run before the belt runs reach the first guide rollers, the traction mechanism being moveable between the second guide rollers in the vicinity of the first guide rollers.

Therefore, the traction mechanism is guided along from one run to the other a short distance before the first two guide rollers, and in so doing connects the two farthest outward guide rollers with one another.

Even if it is not possible to provide the configuration according to the invention at both guide points, the advantages of the invention are still attained to a lesser extent even if the configuration according to the invention is provided on only one side of the traverse winding apparatus, while a conventional configuration of the guide rollers is provided on the other side for structural reasons. The decision as to whether the advantages of the invention can be fully exploited or only partly exploited, depends on the disposition of the winding roller and the cheese relative to the traverse winding apparatus. This also depends on the respective support of the drive roller and on whether the drive roller has its own drive mechanism or a central drive mechanism.

Other features which are considered as characteristic for the invention are set forth in the appended claims.

Although the invention is illustrated and described herein as embodied in a yarn traverse winding apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 3:
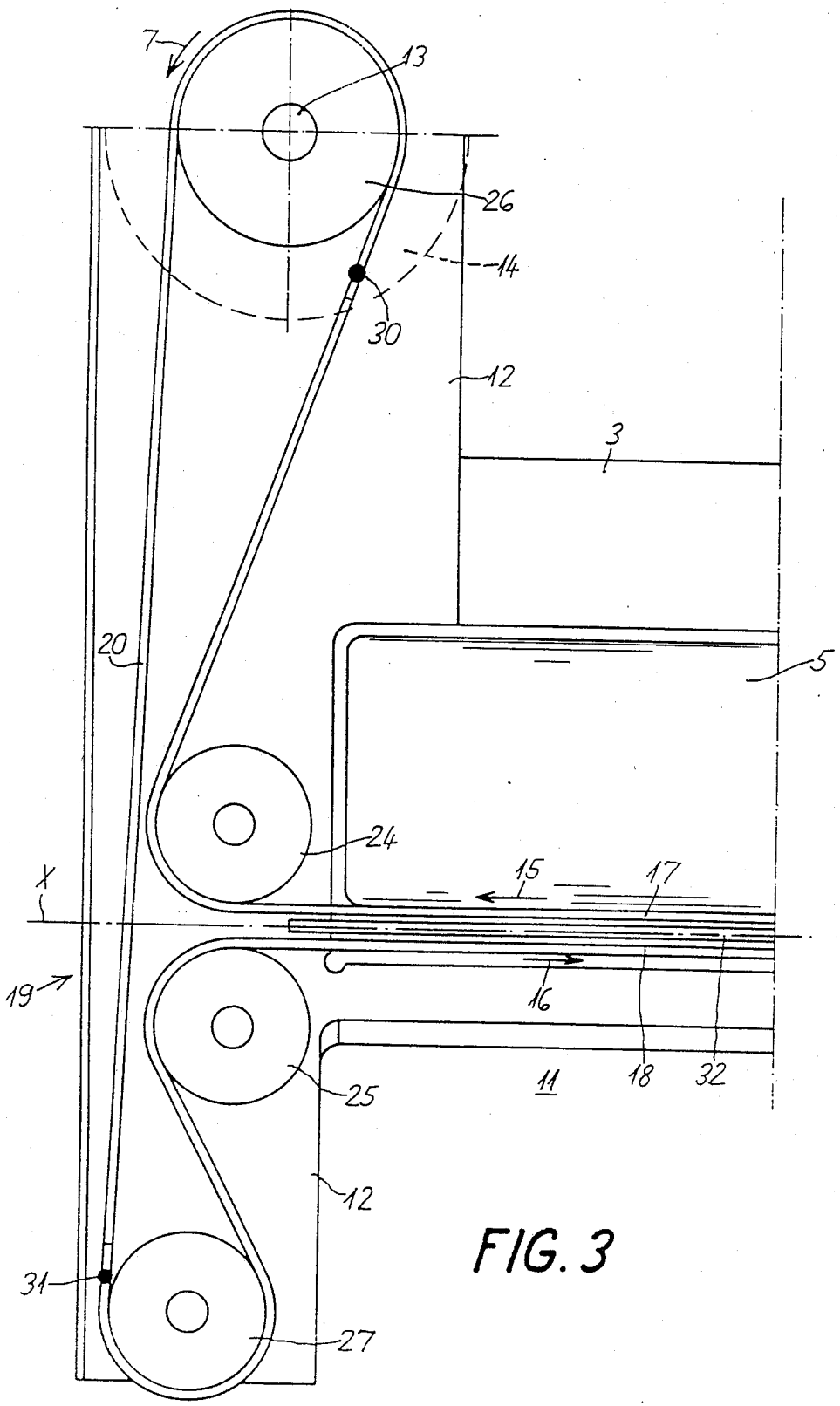

FIG. 1 is a diagrammatic, side-elevational view showing the disposition of a yarn traverse winding apparatus with respect to a winding roller and a cheese; and FIGS. 2 and 3 are right and left portions of a top-plan view showing the disposition of the yarn traverse winding apparatus according to the invention.

Referring now to the figures of the drawing in detail and first, particularly, to FIG. 1 thereof, there is seen a part of a textile machine, which is identified overall by reference numeral 1, that produces cross-wound bobbins or cheeses 2. The shaft 4 of a bobbin drive roller 5 is supported in a stationary machine frame 3 shown in FIG. 2, in such a way as to rotate in the direction of an arrow 6. The bobbin drive roller 5 drives the cheese 2 by friction. A non-illustrated, pivotably suspended bobbin arm rotatably supports the tube 8 of the cheese 2 which rotates in the direction of an arrow 9.

Yarn or thread 10 which is wound to make the cheese 2 is drawn from a non-illustrated yarn supply element, then travels through a yarn traverse winding apparatus identified overall by reference numeral 11, contacts the drive roller 5 at a tangent, and then runs up onto the cheese 2. The traverse winding apparatus 11 is disposed on an equipment frame 12, as can be seen particularly from FIGS. 2 and 3. The equipment frame 12 is in the form of a slab which is reinforced by bending and is connected to the machine frame 3.

FIGS. 2 and 3 in particular show that the traverse winding apparatus 11 has a traction mechanism transmission or gearing 19 with a traction, tension or drawing mechanism or means 20 in the form of an endless belt that is guided over guide or diverting rollers 21–27. All of the guide rollers are rotatably supported on the equipment frame 12. The guide roller 26 is mounted on a shaft 13 of a drive motor 14, which is secured to the equipment frame 12 from below.

The guide rollers are disposed in such a way that in a traversing zone, the traction mechanism 20 forms a first traction mechanism belt run, race or segment 17 traveling in a traversing direction 15 from right to left, and a second traction mechanism belt run, race or segment 18 traveling in a contrary traversing direction 16 from left to right. During operation, the guide roller 26 of the drive motor 14 rotates in the direction of an arrow 7.

FIGS. 2 and 3 show that the belt runs 17 and 18 are spaced apart by approximately 6 mm from one another in the traversing zone on opposite sides of an imaginary line x. Yarn drivers 28–31 which are spaced apart from one another by equal intervals, are disposed along the traction mechanism 20. FIG. 1 indicates that the yarn drivers are constructed as ribs protruding upward from the traction mechanism 20. The leading edges of the yarn drivers are particularly exaggerated in FIGS. 2 and 3. The yarn drivers 28–31 perform the task of guiding the yarn in the traversing zone. At the end of the traversing zone, one yarn driver always gives up the yarn, while another yarn driver that is moving in the contrary direction, engages the yarn and carries it along. This situation is illustrated in FIG. 2, wherein the yarn driver 28 has just given up the yarn 10 and the yarn driver 29 is just in the process of moving the yarn onward in the traversing direction 15. The transfer of the yarn 10 from one yarn driver to the other takes place with the cooperation of a yarn guide element 32, which is likewise secured to the equipment frame 12. The yarn guide element 32 has a concave contour on the upper edge thereof. As indicated diagrammatically in FIG. 1, the contour of the yarn guide element 32 rises above the yarn drivers at the guide or reversing points of the traversing process. In actual practice, the yarn guide giving up the yarn 10 does so even before the receiving yarn guide approaches. This assures the transfer of the yarn and its lateral traverse motion.

FIG. 2 shows that the shaft 4 of the bobbin drive roller 5 is suspended in a bearing 33 secured to the machine frame 3. The shaft 4 has a wharve 34, around which a drive belt 35 is wrapped. The drive belt 35 leads to a non-illustrated drive apparatus for the shaft 4.

Since the bearing 33 projects to the right and due to the aforementioned drive apparatus, there is sufficient space on the right-hand side of the yarn traverse winding apparatus 11 for the guide of the traction mechanism 19 from one belt run to the other to take place in the conventional manner. The surfaces of the belt runs 17, 18 which face each other are considered the inner surfaces and the surfaces which face away from each other are considered the outer surfaces. The traction mechanism belt run 18 is guided about the guide roller 21 with the outer surface of the belt run 18 in contact with the roller 21. The inner surface of the belt run 18 then contacts and is returned about the guide roller 22, and then the inner surface of the belt run 18 contacts the guide roller 23 and wraps around to become the belt run 17. The length of the traction mechanism loop thus formed is dependent on the traversing width and on the spacing of the yarn drivers. The guide rollers 21 and 23 are located and offset in the manner shown because the two traction mechanism belt runs 17 and 18 are spaced apart by such a slight distance from one another.

According to FIG. 3, the guide rollers 24–27 are disposed on the left-hand side of the traversing apparatus 11 in such a way that the traversing apparatus 11 protrudes to the left as little as possible past the traversing zone. A relatively large drive motor 14 can then easily be disposed in the rear portion of the textile machine, behind the bobbin drive roller 5, without having to compromise by making the applicable winding station laterally wider.

At the guide or reversing point, the outer surface of the belt run 17 of the traction mechanism 20 is in contact with the guide roller 24 and is guided outwardly away from the imaginary line x and then returned again toward the imaginary line x about the further guide roller 26 with the inner surface of the belt run 17 in contact with the roller 26. Similarly, the other belt run 18 of the same traction mechanism 20 is returned again toward the imaginary line x about the guide roller 27, with the inner surface of the belt run 18 in contact with the roller 27 and at the guide or reversing point it is guided about the guide roller 25 opposite the first guide roller 24, with the outer surface of the belt run 18 in contact with roller 25. The traction mechanism 20 is guided along between the first guide rollers 24 and 25 from one belt run 17 to the other belt run 18 and extends between the guide rollers 26 and 27 which are farthest outward from the imaginary line x. It can be seen that the first guide rollers 24, 25 are spaced from the imaginary line running along the traversing zone between the belt runs by a distance less than the distance between the second guide rollers 26, 27 and the imaginary line. Therefore, the traction mechanism 20 is guided between the second rollers 26, 27 over a short distance as seen along the imaginary line x between the first rollers 24, 25.

In order to ensure that the traversing apparatus 11 protrudes as little as possible to the left, as mentioned above, the belt runs 17 and 18 wind around the first guide rollers 24 and 25 through an angle greater than 90°. For the same reason, besides the first guide rollers 24, 25 being disposed at one end (the left end) of the traversing zone, the second guide roller 26 is disposed further to the right than the first guide rollers 24, 25. Accordingly, guide roller 26 has a shaft 13 defining a plane passing through the shaft and passing perpendicular through the imaginary line x in a direction perpendicular to the imaginary line between axes of the first guide rollers 24, 25 and the other end of the traversing zone.

I claim:

1. Yarn traverse winding apparatus for a textile machine producing cross-wound bobbins, comprising a yarn traversing zone having reversing points defining ends of said yarn traversing zone, guide rollers, a traction mechanism transmission having an endless traction mechanism being diverted outside said traversing zone by said guide rollers between a first belt run movable in a given traversing direction and a second belt run movable parallel to said first belt run in an opposite traversing direction, said belt runs having inner surfaces facing toward each other and outer surfaces facing away from each other while in said traversing zone, yarn drivers mutually spaced apart along said traction mechanism, a yarn guide element transferring yarn at said reversing points from a yarn driver on one of said belt runs to a yarn driver on the other of said belt runs, said guide rollers including two first inner guide rollers both being disposed at one of said ends of said traversing zone and each guiding and contacting said outer surface of a respective belt run and two second outer guide rollers spaced apart from said first guide rollers and each returning and contacting said inner surface of a respective belt run between said first guide rollers, said traction mechanism being moveable between said second guide rollers in the vicinity of said first guide rollers.

2. Yarn traverse winding apparatus according to claim 1, wherein said first guide rollers are spaced a given distance from an imaginary line running along said traversing zone between said belt runs, and said second guide rollers are disposed at said one end of said traversing zone and are spaced from said imaginary line by a distance greater than said given distance.

3. Yarn traverse winding apparatus for a textile machine producing cross-wound bobbins, comprising a yarn traversing zone having reversing points and two ends, an endless traction mechanism having a first belt run movable in a given traversing direction and a second belt run movable parallel to said first belt run in an opposite traversing direction through said traversing zone, two first guide rollers each diverting a respective belt run at one of said ends of said traversing zone, and two second guide rollers each returning a respective belt run between said first guide rollers, said belt runs having inner surfaces facing toward each other and outer surfaces facing away from each other while in said traversing zone, said first guide rollers each contacting said outer surface of a respective belt run, and said second guide rollers each contacting said inner surface of a respective belt run.

4. Yarn traverse winding apparatus according to claim 1, wherein said belt runs wind around said first guide rollers through an angle greater than 90°.

5. Yarn traverse winding apparatus according to claim 1, wherein said reversing points define an imaginary line passing through said reversing points, one of said second guide rollers has a shaft defining a plane passing through said shaft and passing perpendicular through said imaginary line in a direction perpendicular to said imaginary line between axes of said first guide rollers and the other of said ends of said traversing zone.

* * * * *